United States Patent [19]

Lamson

[11] Patent Number: 4,649,678

[45] Date of Patent: Mar. 17, 1987

[54] MARKER POST SYSTEM

[76] Inventor: Frederick W. Lamson, 725 S. Glenhurst Dr., Birmingham, Mich. 48009

[21] Appl. No.: 820,068

[22] Filed: Jan. 21, 1986

[51] Int. Cl.[4] ..... E04H 13/00; E01F 9/02

[52] U.S. Cl. ..... 52/103; 52/105; 52/165; 52/742; 248/530

[58] Field of Search ..... 52/105, 103, 155, 156, 52/165, 742; 248/530

[56] References Cited

U.S. PATENT DOCUMENTS

| | | | |
|---|---|---|---|
| 1,153,450 | 9/1915 | Schaff | 52/155 |
| 1,257,215 | 2/1918 | Greene | 248/530 |
| 1,528,056 | 3/1925 | Herbert | 52/103 |
| 1,943,018 | 1/1934 | Hench | 52/165 |
| 2,867,041 | 1/1959 | McMillan | 52/155 X |
| 3,342,444 | 9/1967 | Nelson | 52/165 |
| 3,700,196 | 10/1972 | Hall | 52/165 X |
| 3,894,589 | 7/1975 | Ciraud | 52/165 X |
| 4,120,125 | 10/1978 | Cvetan | 52/156 |
| 4,252,472 | 2/1981 | Moraly | 52/165 X |
| 4,553,358 | 11/1985 | Deike | 52/165 X |

*Primary Examiner*—Alfred C. Perham

*Attorney, Agent, or Firm*—Krass & Young

[57] ABSTRACT

A boundary marking system comprising cylindrical receptacles having relatively large plates flush with one end and adapted to be installed in the ground with the plate at ground level. A marker stake which is color coded to the top of the plate is placed in the receptacle through a hole in the plate so that the stake extends a foot or so above ground to mark a boundary. Because of the color coding, installation and replacement of the stakes is facilitated. Moreover the particular character of the marked boundary may be perceived not only by the color of the stake, but also by the color of the flush plate even if the stake is missing. A hole maker to facilitate installation of the receptacle is also disclosed.

10 Claims, 4 Drawing Figures

MARKER POST SYSTEM

INTRODUCTION

This invention relates to boundary marker systems and the like and more particularly to a method and apparatus for conveniently marking the boundaries of a playing field such as a golf course using inexpensive and easily maintained apparatus.

BACKGROUND OF THE INVENTION

It is common to define both exterior boundaries and lateral hazards of a golf course with painted stakes which are driven into the ground; exterior boundary stakes are typically white, lateral hazard markers are typically red and water hazards are typically yellow.

Although the stakes are usually made of wood and are therefore inexpensive to fabricate, they create a maintenance problem due to the fact that they are relatively immobile and often interfere with the golfer's ability to take a proper stand for a stroke. More specifically, a ball which comes to rest sufficiently close to a marker stake so as to interfere with the swing or the line of flight presents the golfer with the need to either move the ball, which is an infraction of the rules of golf, or remove the stake. If the stake is relatively loose in the ground, it may be summarily removed and dispatched by the golfer where upon it must be found and replaced by the maintenance crew.

Moreover, stakes which are simply driven into the ground present obstacles to golf course maintenance personnel in that they interfere with the use of mowing equipment. Again, the area immediately around the stake must either be left uncut or laboriously trimmed by hand. Alternatively, the mower operator can stop the mower, remove the stake, mow the area and replace the stake, a time consuming process.

SUMMARY OF THE INVENTION

Briefly summarized, the invention is a system for marking boundaries and for providing removable above ground stake-like structures in such a fashion as to facilitate installation, maintenance and even replacement. In general the combination of the invention comprises a receptacle for in-ground installation and comprising a generally cylindrical body of rigid material such as steel or plastic having at least one open end and a plate which is fastened to the body substantially flush with the open end. By this arrangement the receptacle may be pushed into a premade hole in the earth with the plate at ground level. The plate is formed with an aperture which is coextensive with the open end of the body and hence the plate prominently marks the location of the receptacle. The combination further comprises a stake or post which is of such diameter as to easily fit within the receptacle through the opening in the plate and of such length as to extend and show substantially above the plate. By this arrangement the stake may be easily and readily removed and a mower run over the flush plate and the stake quickly and inexpensively put back in place. Moreover the stake may be replaced if it is removed and inadvertently lost.

In the preferred embodiment both the plate and the stake are marked with identical indicia such as color so as to associate the receptacle and stake with one another and also to provide a back-up marking system for the golfer in the event the stake is removed and lost before he appears on the scene; i.e., the golfer can identify a lateral boundary marking simply by observing the red surface on the flush plate.

The invention, when assembled as a kit or product combination may further include a hole maker comprising a post-like device having a sharpened end and a foot plate and spacer which is spaced from the sharpened end by the effective length of the marker receptacle.

The method of the invention comprises the steps of forming a hole in the ground of appropriate depth, pushing the receptacle into the hole until the plate is flush with the ground and thereafter placing a stake in the receptacle to show clearly and prominently above ground. Again the receptacle plate and the stake are preferably color matched not only for association but for back-up marking purposes as described above.

DETAILED DESCRIPTION OF THE SPECIFIC EMBODIMENT

Figure 1:
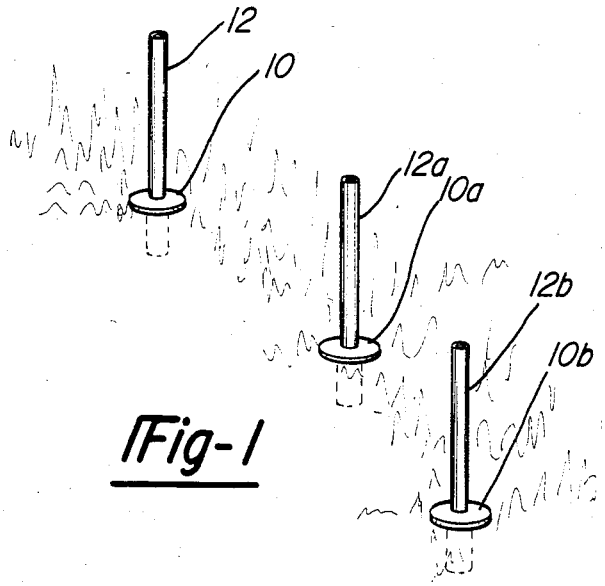
FIG. 1 is a view of a boundary marked with the use of a device incorporating the invention.

FIG. 1 shows a series of marker stakes 12, 12*a* and 12*b* inserted into receptacles exhibiting plates 10, 10*a* and 10*b*, respectively, which are flush with the ground. The stakes 12, 12*a* and 12*b* are arranged essentially in a line and, for purposes of illustration, represent the out-of-bounds boundary of a golf course. Both the stakes 12, 12*a* and 12*b* and the plates 10, 10*a* and 10*b* of the associated receptacles are, accordingly, white in color.

Looking now to FIGS. 2 and 3 the specific construction of the receptacle and stake structure will be described in greater detail.

Figure 2:
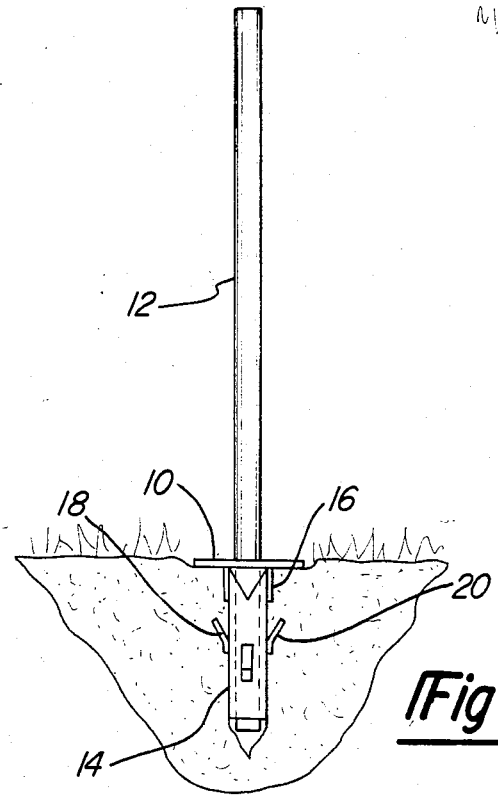
FIG. 2 is a side view of an installed device incorporating the invention.
Figure 3:
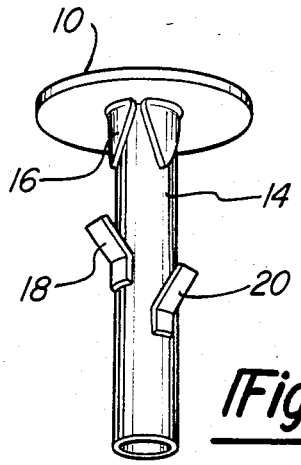
FIG. 3 is a perspective view of the receptacle part of the system.

As shown in FIG. 2 the receptacle 14 comprises an essentially cylindrical body which may be fabricated from a rigid and durable material such as plastic or steel, is on the order of 6 to 10 inches in axial length and on the order of 1½ inches in outside diameter. These dimensions are of course merely illustrative and it should also be noted that the term "cylindrical", as used herein, does not necessarily denote a regular and circular cross sectional configuration so much as it denotes a sleeve-like body; in short, cross sectional shape is unimportant and can be oblong, square or what have you. The receptacle 14 has open ends and has fastened thereto, flush with the upper open end, a 4-inch diameter plate 10 which is also constructed of a rigid and durable material such as plastic or steel. The plate is provided with tangs 16 which may generate a friction fit with the receptacle body 14 although, in the case of plastic, it may be advisable to utilize an adhesive to secure the plate 10 to the receptacle body 14 and, in the case of steel, it may be desirable to weld. The plate, as illustrated in FIG. 1, can be round, but shape is not important; it has a central aperture which is coextensive with the open upper end of the receptacle body 14 for purposes of admitting the stake 12.

Stake 12 is a relatively lightweight plastic or somewhat less lightweight steel post of approximately 20 to 24 inches in length and is of a diameter which will permit it to be easily and non-frictionally inserted into the receptacle 14 when the receptacle is installed in the ground with the plate 10 flush with the surface of the ground as shown in FIG. 2. Of course, it can also be wood.

Receptacle 14 is preferably provided with a series of barb-like tangs 18 and 20 which are angled in the upwardly direction to inhibit the removal of the receptacle 14 from the in-ground installation shown in FIG. 2.

Figure 4:
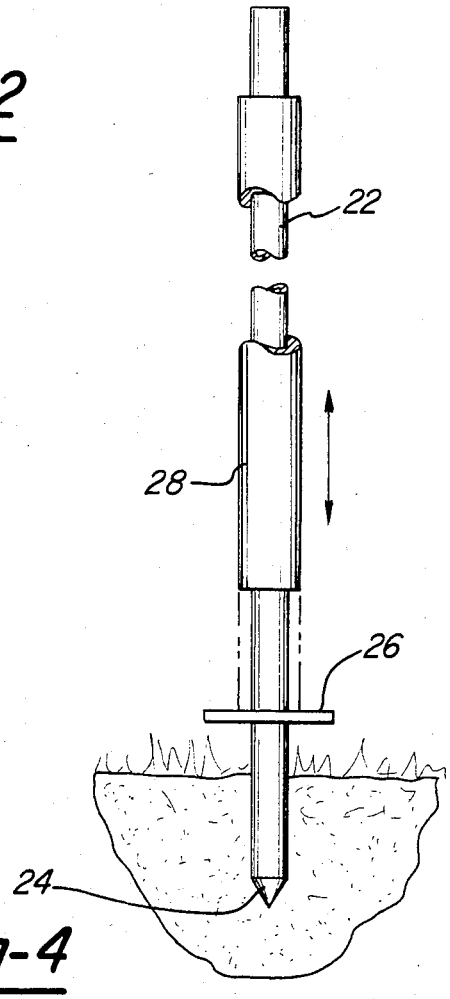
FIG. 4 is a side view of a hole-maker.

To install the receptacle 14 in the ground it is preferable to provide a hole maker of the type shown in FIG. 4. The hole maker is a relatively simple but sturdy device and comprises a 4 foot length of steel pipe 22 having braised or welded into the end thereof a solid steel piercing point 24 to facilitate the entry of the hole maker into the ground. A step plate 26 is welded to the exterior surface of the pipe 22 approximately 6 to 8 inches form the piercing point 24 so as to correspond in length to the length of the receptacle 14. If necessary to form holes in hard ground, a loose fitting pile driver sleeve 28 of steel may be loosely disposed about the pipe 22 so that it may be operated in the manner of a ram against the reaction surface provided by step plate 26 to drive the piercing point 24 into the ground. The hole which is made corresponds in both diameter and length to the receptacle 14 so that the receptacle may be easily but snuggly pushed into the hole.

The overall installation procedure is as follows. First a hole of 6 to 8 inches in length and approximately 1½ inches in diameter is formed by driving the piercing point 14 of the pipe 22 into the ground until the step plate 26 is flush with the ground. The hole maker comprising pipe 22, pile driver ram 28 and step plate 26 is then removed from the hole. Next the receptacle 14 is pushed into the hole until the flush plate 10 is at ground level. A stake 12 is then dropped into the hole.

For maximum benefit from the system of the invention indicia such as surface color are provided for both the flush plate 10 and the stake 12 and the indicia of the plate 10 and stake 12 are matched. Where color is the indicia, and this is preferred, both the exposed, viewable surface of the plate 10 and the exterior surface of the stake 12 are, for example, red. This indicates a lateral hazard boundary and, even if the stake 12 were to be removed and discarded, the alert golfer will be able to perceive the location and character of the boundary simply by observing the color of the plate 10. The same color match makes it a relatively simple matter for the installer of the system or the personnel who replace stakes during the season or in the spring, to match stakes 12 with plates 10 at the various marked boundaries.

It is feasible, although less desirable, to mark the plates 10 and stakes 12 with other indicia such as "OB", "LH" and so forth. In addition to marking plating boundaries on a golf course the receptacle and stake arrangement of the present invention may be used to mark other boundaries or simply to establish a fence line. In this regard it is possible to place adapters on top of the stakes 12 and string lightweight chain link fencing to establish a lower level and primarily decorative fence line.

It is self-evident that the stakes 12 may be constructed of various materials including not only plastic and steel but wood and other inexpensive and durable materials. They may be hollow or solid and, as with the receptacle 14, cross sectional shape is of little or no consequence so long as it is essentially compatible with the cross sectional configuration of the receptacle 14.

I claim:

1. A boundary marker system comprising:

a receptacle for inground installation comprising a cylindrical body having at least one open end;

a separate plate fastened to said body substantially flush with said end to mark the location of said receptacle when installed in the ground with said plate at ground level;

said plate having indicia and having an aperture therein coextensive with the open end of said body; and a stake of diametral size to fit easily within said body, of substantially greater length than said body so as to extend and show above ground level when placed within said receptacle, and having an indicia corresponding to the indicia of said plate to facilitate matching of specific plate indicia with specific stake indicia.

2. A system as defined in claim 1 wherein said system includes a plurality of receptacles, a plurality of plates having a plurality of different indicia, and a plurality of stakes having a plurality of different indicia corresponding to the different indicia of said plates whereby to facilitate placement of the respective stakes of different indicia in the receptacles having plates of respective corresponding indicia.

3. Apparatus as defined in claim 2 wherein said indicia is color.

4. A system as defined in claim 1 and further including barb-like tangs on the exterior surface of said receptacle body to inhibit removal of said body from an inground installation.

5. A system as defined in claim 1 wherein said stake is constructed of plastic.

6. A system as defined in claim 1 wherein said system further includes a hole maker device for use in the installation of said receptacle comprising a manually manipulable post having a diameter approximating the outside diameter of said receptacle body and a sharpened distal end, and a step plate on said post spaced from said distal end by the length of said receptacle body.

7. A method of marking boundaries comprising the steps of:

(a) forming a substantially cylindrical hole in the earth of length L with a hole marker device;

(b) withdrawing the hole marker device from the earth to expose the formed cylindrical hole;

(c) rigidly securing a plate having a specific indicia to the upper end of a cylindrical receptacle of length L;

(d) placing the rigid cylindrical receptacle in said hole so that the plate lies substantially at ground level with its indicia exposed to view;

(e) providing a stake having a specific indicia corresponding to the indicia of said plate and having a length X substantially greater than the length L; and (f) placing the stake within the implanted receptacle so that a substantial length of the stake shows above the plate and the indicia of the exposed stake visually matches the indicia of the plate.

8. The method of claim 7 wherein the indicia is color.

9. The method of claim 7 wherein:

a plurality of receptacles are provided;

a plurality of plates having a plurality of different indicia are provided;

a plurality of stakes having a plurality of different indicia corresponding to the different indicia of the plates are provided; and the respective stakes of different indicia are selectively placed in the receptacles having the plates of respective corresponding indicia to provide a boundary marker system incorporating a plurality of matching plate and stake indicia corresponding to a plurality of different boundary system criteria.

10. A method of claim 9 wherein the indicia is color.

* * * * *